US010770827B2

(12) United States Patent
Tsai

(10) Patent No.: US 10,770,827 B2
(45) Date of Patent: Sep. 8, 2020

(54) WATERPROOF STRUCTURE FOR PREVENTING WATER FROM PENETRATING INTO ELECTRONIC PRODUCTS AND WATERPROOF ANNULAR RING

(71) Applicant: PHIHONG TECHNOLOGY CO., LTD., Taoyuan (TW)

(72) Inventor: Ming-Ching Tsai, Taoyuan (TW)

(73) Assignee: PHIHONG TECHNOLOGY CO., LTD., Taoyuan (TW)

( * ) Notice: Subject to any disclaimer, the term of this patent is extended or adjusted under 35 U.S.C. 154(b) by 0 days.

(21) Appl. No.: 15/968,966

(22) Filed: May 2, 2018

(65) Prior Publication Data

US 2019/0221959 A1 Jul. 18, 2019

(30) Foreign Application Priority Data

Jan. 18, 2018 (TW) ..... 107101895 A

(51) Int. Cl.
*H01R 13/52* (2006.01)
*H01F 27/02* (2006.01)
*H01R 13/516* (2006.01)

(52) U.S. Cl.
CPC ..... *H01R 13/5202* (2013.01); *H01F 27/02* (2013.01); *H01R 13/516* (2013.01)

(58) Field of Classification Search
USPC ..... 439/274, 275, 587, 588, 589, 148, 936, 439/352
See application file for complete search history.

(56) References Cited

U.S. PATENT DOCUMENTS 5,603,637 A * 2/1997 Matsuoka ..... H01R 13/5205 439/587
5,824,962 A * 10/1998 Katsuma ..... H01R 13/5205 174/135

* cited by examiner

*Primary Examiner* — Phuong Chi Thi Nguyen
(74) *Attorney, Agent, or Firm* — Muncy, Geissler, Olds & Lowe, P.C.

(57) ABSTRACT

The present invention discloses an annular ring for preventing water from penetrating into electronic products including: an annular ring body, the cross section of the annular ring body having a shape with a concave notch; wherein the notch sleeves a protruded edge on a component in an electronic product. In another aspect, the present invention discloses an annular ring for preventing water from penetrating into electronic products including: an annular ring body, the cross section of the annular ring body is slice shaped; wherein the annular ring body is disposed at the lateral side of a protruded edge on a component in an electronic product, such that the lateral surface of the annular ring body fits the lateral surface of the protruded edge.

10 Claims, 7 Drawing Sheets

WATERPROOF STRUCTURE FOR PREVENTING WATER FROM PENETRATING INTO ELECTRONIC PRODUCTS AND WATERPROOF ANNULAR RING

FIELD OF THE INVENTION

The present invention relates to annular ring, and particularly to a waterproof structure for preventing water from penetrating into electronic products and a waterproof annular ring.

BACKGROUND OF THE INVENTION

An O-ring, also known as a packing, or a toric joint, is a mechanical gasket in the shape of a torus; it is a loop of elastomer with a round cross-section, designed to be seated in a groove and compressed during assembly between two or more parts, creating a seal at the interface.

O-rings are one of the most common seals used in machine design because they are inexpensive, easy to make, reliable and have simple mounting requirements. They can seal tens of megapascals (thousands of psi) of pressure. The O-ring may be used in static applications or in dynamic applications where there is relative motion between the parts and the O-ring. Dynamic examples include rotating pump shafts and hydraulic cylinder pistons.

O-ring materials may fail because of high or low temperatures, chemical attack, vibration, abrasion, and movement. Elastomers are selected according to the situation.

There are O-ring materials which can tolerate temperatures as low as 73K or as high as 523K. At the low end, nearly all engineering materials become rigid and fail to seal; at the high end, the materials often burn or decompose. Chemical attack can degrade the material, start brittle cracks or cause it to swell. For example, NBR seals can crack when exposed to ozone gas at very low concentrations, unless protected. Swelling by contact with a low viscosity fluid causes an increase in dimensions, and also lowers the tensile strength of the rubber. Other failures can be caused by using the wrong size of ring for a specific recess, which may cause extrusion of the rubber.

A traditional O-ring is typically the structure shown in FIG. 1. Please refer to FIG. 1, which illustrates the configurations and mounting setting of the traditional O-ring. Generally, the traditional O-ring 102 is disposed in a groove 104 of an electronic product 100 and must be pushed inwards and to the bottom of the groove 104, so as to achieve the waterproof function when being combined with a protruded edge of a housing. However, the traditional O-ring suffers from some problems. For example, if the O-ring is not completely pushed to the bottom of the groove 104 when being mounted and only part of the O-ring is pushed to the bottom, part of the O-ring fits the protruded edge of the housing and the other part of the O-ring is not attached to the protruded edge of the housing during assembly, which will cause water to penetrate into the electronic product. In other words, the waterproof function of the traditional O-ring can be reduced or fail easily because different persons or different machines assemble the electronic product in different ways.

Therefore, there is still a need for a solution which can solve the problem that the waterproof function of the traditional O-ring can be reduced or fail easily because of different assembling methods.

SUMMARY OF THE INVENTION

To overcome the problems that the waterproof function of the traditional O-ring can be reduced or fail easily because of different assembling methods, the present invention provides a novel annular ring for preventing water from penetrating into electronic products.

In one aspect, the present invention discloses an annular ring for preventing water from penetrating into electronic products, including: an annular ring body, a cross-section of the annular ring body having a shape with a concave notch; wherein the notch sleeves a protruded edge on a component of an electronic product.

In one embodiment, an outer lateral surface of the annular ring body may fit a lateral wall of a concave groove in a housing of the electronic product. In one embodiment, the shape with the concave notch may include U shape. In one embodiment, the annular ring body may be square or circular. In one embodiment, the electronic product may include a transformer, and the component may include a socket.

In another aspect, the present invention discloses an annular ring for preventing water from penetrating into electronic products, including: an annular ring body, a cross-section of the annular ring body is slice shaped; wherein the annular ring body is disposed at a lateral side of a protruded edge on a component of an electronic product, such that a lateral surface of the annular ring body fits a lateral surface of the protruded edge.

In one embodiment, one or more strip-shaped protruded portions may be formed on another lateral surface of the annular ring body to provide non-skid function. In one embodiment, the another lateral surface may fit a lateral wall of a concave groove in a housing of the electronic product. In one embodiment, another lateral surface of the protruded edge may fit another lateral wall of the concave groove in the housing of the electronic product. In one embodiment, the annular ring body may be square or circular. In one embodiment, the electronic product may include a transformer, and the component may include a socket.

In still another aspect, the present invention discloses a waterproof structure for preventing water from penetrating into electronic products, including: an electronic product housing having a protruded edge; an annular ring body, a cross-section of the annular ring body having a shape with a concave notch, wherein the notch sleeves the protruded edge, wherein an outer lateral surface of the annular ring body fits a lateral wall of a concave groove in the electronic product housing.

One advantage of the present invention is that the annular ring for preventing water from penetrating into the electronic product of the present invention can achieve the function of enabling the annular ring to be mounted steadily and easily, and rendering the annular ring not to be shifted easily and not to fall off easily.

Another advantage of the present invention is that the annular ring for preventing water from penetrating into the electronic product of the present invention can achieve the function of rendering the annular ring not to have waterproof effect reduced due to different assembling methods.

These and other advantages will become apparent from the following description of preferred embodiments taken together with the accompanying drawings and the appended claims.

BRIEF DESCRIPTION OF THE DRAWINGS

The present invention may be understood by some preferred embodiments and detailed descriptions in the specification and the attached drawings below.

DETAILED DESCRIPTION OF THE PREFERRED EMBODIMENT

The present invention will now be described with the preferred embodiments and aspects and these descriptions interpret structure and procedures of the present invention only for illustrating but not for limiting the Claims of the present invention. Therefore, except the preferred embodiments in the specification, the present invention may also be widely used in other embodiments.

References throughout the specification to "one embodiment" or "an embodiment" means that a particular feature, method, or characteristic described in connection with the embodiment is included in at least one embodiment of the present invention. Thus, the appearances of the phrase "in one embodiment" or "in an embodiment" in various places throughout the specification are not necessarily all referring to the same embodiment. Furthermore, the particular features, methods, or characteristics may be combined in any suitable manner in one or more embodiments.

Figure 1:
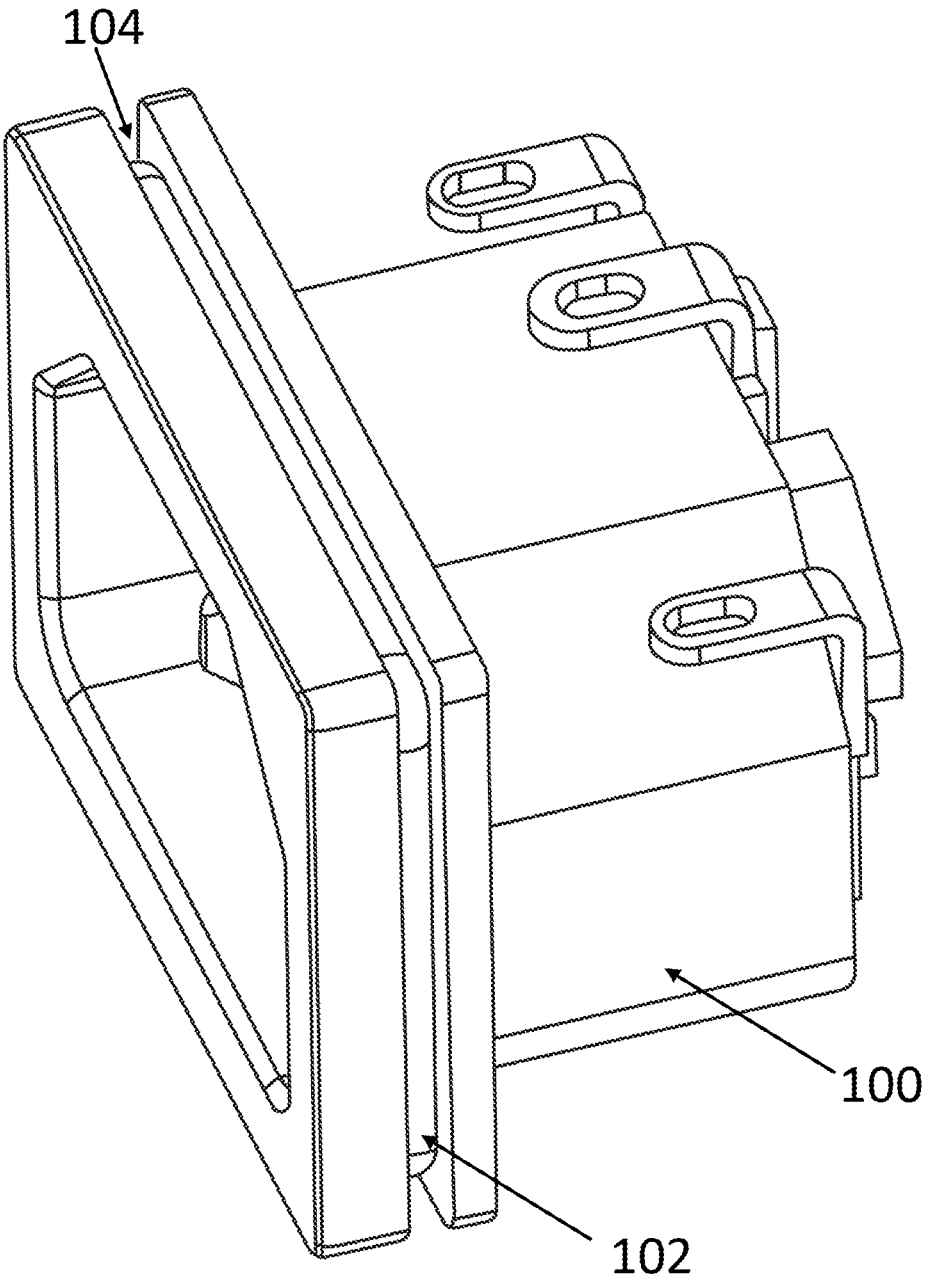
FIG. 1 illustrates a diagram showing a traditional O-ring mounted onto the electronic product.
Figure 2:
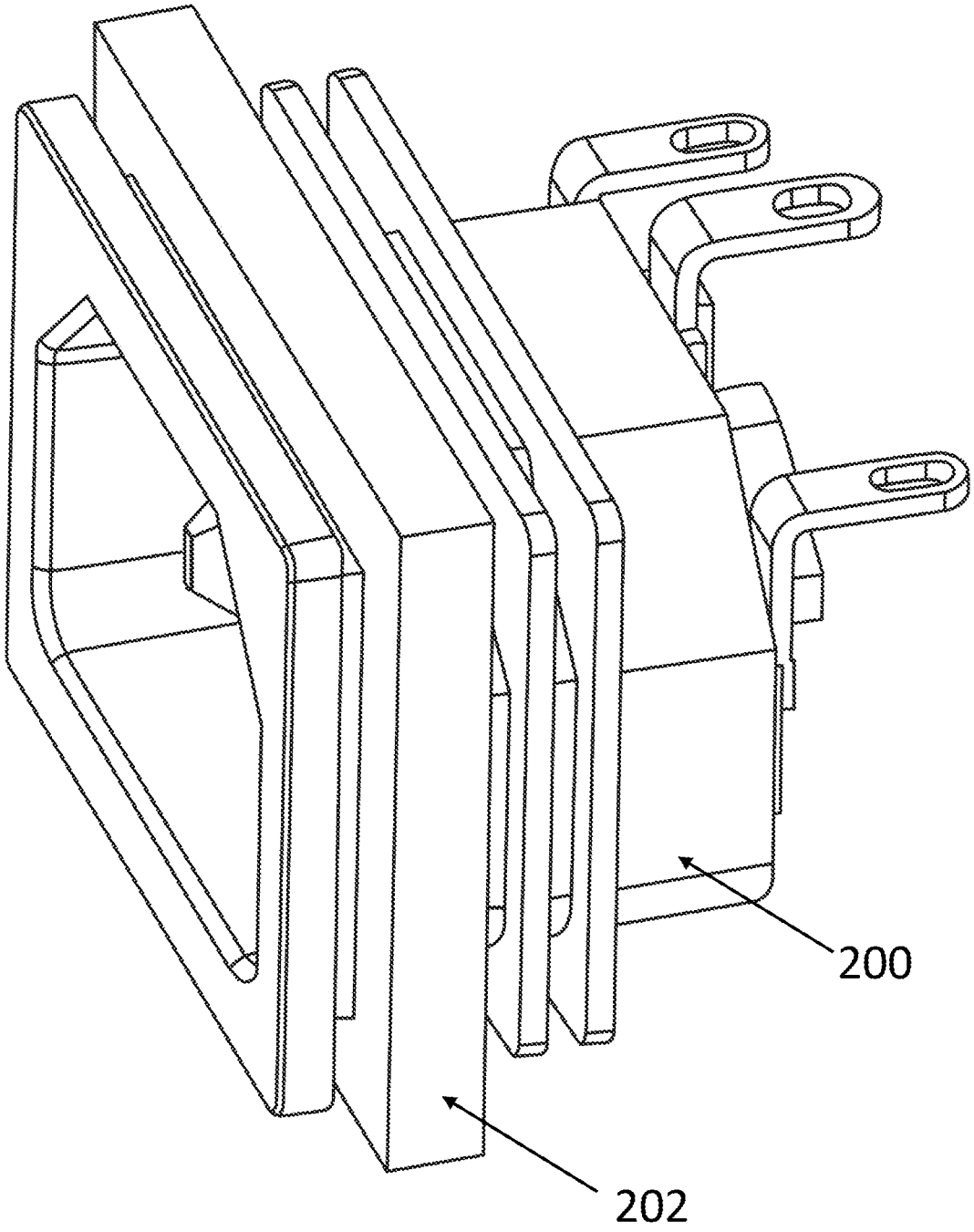
FIG. 2 illustrates a diagram showing an annular ring for preventing water from penetrating into the electronic product of the present invention mounted onto the electronic product in accordance with one embodiment.
Figure 3:
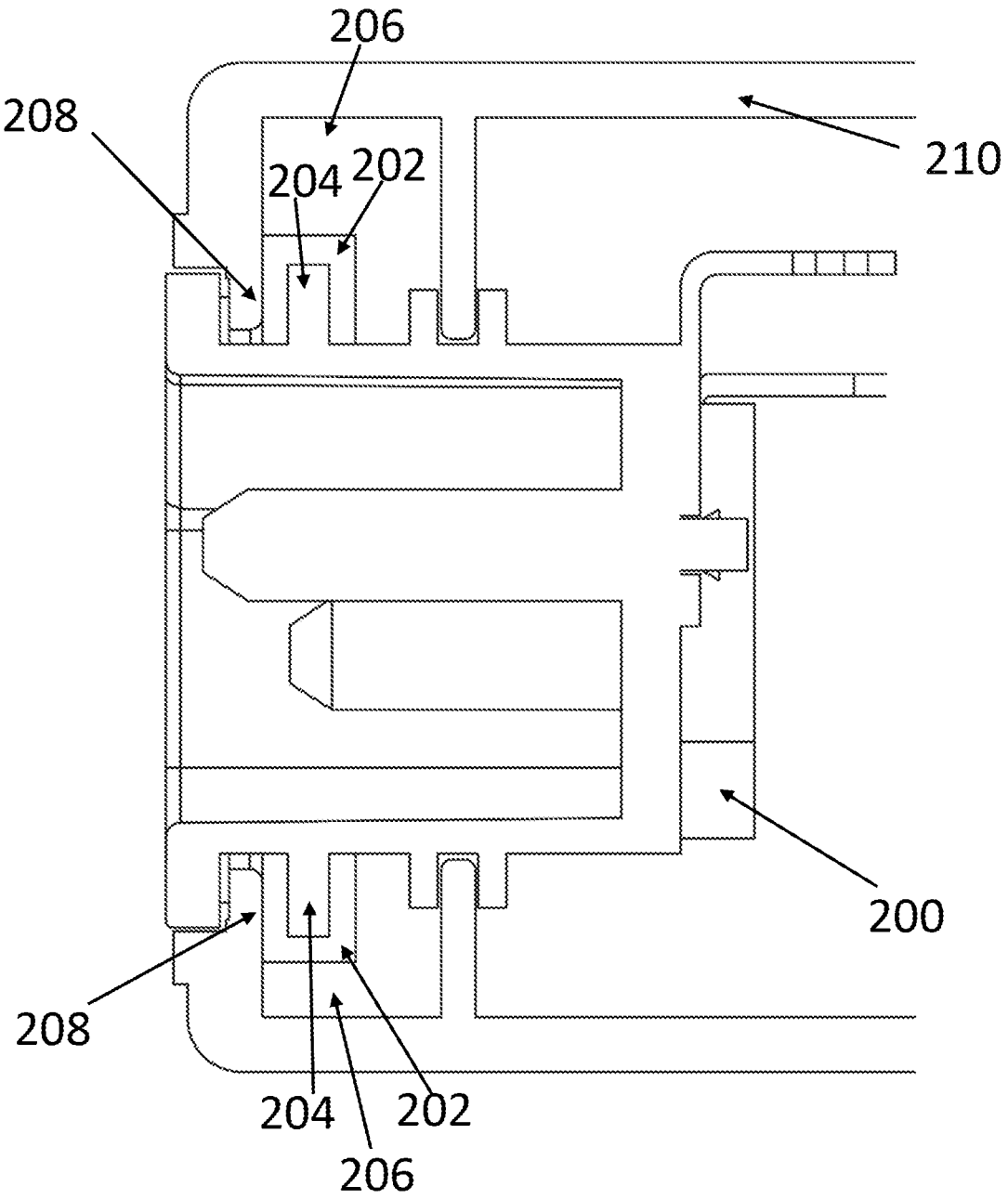
FIG. 3 illustrates a cross-sectional diagram showing the annular ring for preventing water from penetrating into the electronic product of the present invention mounted onto the electronic product in accordance with one embodiment.

The present invention provides a novel annular ring for preventing water from penetrating into the electronic product, which may be applied to any electronic products that need waterproof design, for instance but not limited to the socket of the transformer. Please refer to FIGS. 2 and 3. In one embodiment, the cross-section of the annular ring for preventing water from penetrating into the electronic product 202 of the present invention may have a shape with a concave notch, such as U shape. In one embodiment, the annular ring for preventing water from penetrating into the electronic product 202 may be manufactured by molding. In one embodiment, the annular ring for preventing water from penetrating into the electronic product 202 may be made of synthetic rubber (also known as thermosetting polymer) for example but not limited to butadiene rubber (BR), isobutylene isoprene rubber (IIR), complete supplement mixture (CSM), ethylene propylene diene monomer (EPDM), ethylene-propylene rubber (EPR), fluorocarbon (FKM), nitrile butadiene rubber (NBR), perfluoroelastomer (FFKM), polyacrylate rubber (ACR), chloroprene rubber (CR), polyisoprene rubber (IR), polysulfide rubber (PSR), silicone rubber (SIR), styrene butadiene rubber (SBR), or thermoplastics for instance but not limited to thermoplastic elastomer (TPE) (for example styrene), thermoplastic polyolefin (TPO) (such as low density polyethylene (LDPE), high density polyethylene (HDPE), linear low density polyethylene (LLDPE), ultra low density polyethylene (ULDPE)), thermoplastic polyurethane (TPU) (for instance polyether, polyester), thermoplastic polyester/polyether elastomers (TEEE), thermoplastic polyamide (TPA) (for example polyamide), melt processable rubber (MPR), thermoplastic vulcanizate (TPV). As shown in FIGS. 2 and 3, the U shaped notch of the annular ring for preventing water from penetrating into the electronic product 202 may sleeve the protruded edge 204 on the electronic product for instance, but not limited to, the socket 200 of the transformer to tightly fit the protruded edge 204. In one embodiment, one or more strip-shaped protruded portions (not shown) may be optionally formed on one or two outer lateral surfaces of the annular ring for preventing water from penetrating into the electronic product 202 to provide non-skid function. Thus, the dimension and the shape of the U-shaped notch of the annular ring for preventing water from penetrating into the electronic product 202 match the dimension and the shape of the protruded edge 204. As shown in FIG. 3, the annular ring for preventing water from penetrating into the electronic product 202 sleeving the protruded edge 204 may be further disposed in the concave groove 206 in the housing 210, such that an outer lateral surface of the annular ring for preventing water from penetrating into the electronic product 202 tightly fits a lateral wall 208 of the concave groove 206, so as to achieve the waterproof effect. The annular ring can be mounted easily, cannot be shifted easily, will not fall off easily and will not have waterproof effect reduced due to different assembling methods because the annular ring for preventing water from penetrating into the electronic product 202 shown in FIGS. 2 and 3 has a U-shaped notch which may sleeve the protruded edge 204. It should be appreciated by the person having ordinary skill in the art that FIGS. 2 and 3 are shown for illustrating, not for limiting the present invention. Therefore, the annular ring for preventing water from penetrating into the electronic product 202 is not limited to the square shape shown in FIGS. 2 and 3, and may be in the shape of circle, rectangle, hexagon or any other applicable shapes.

Figure 4:
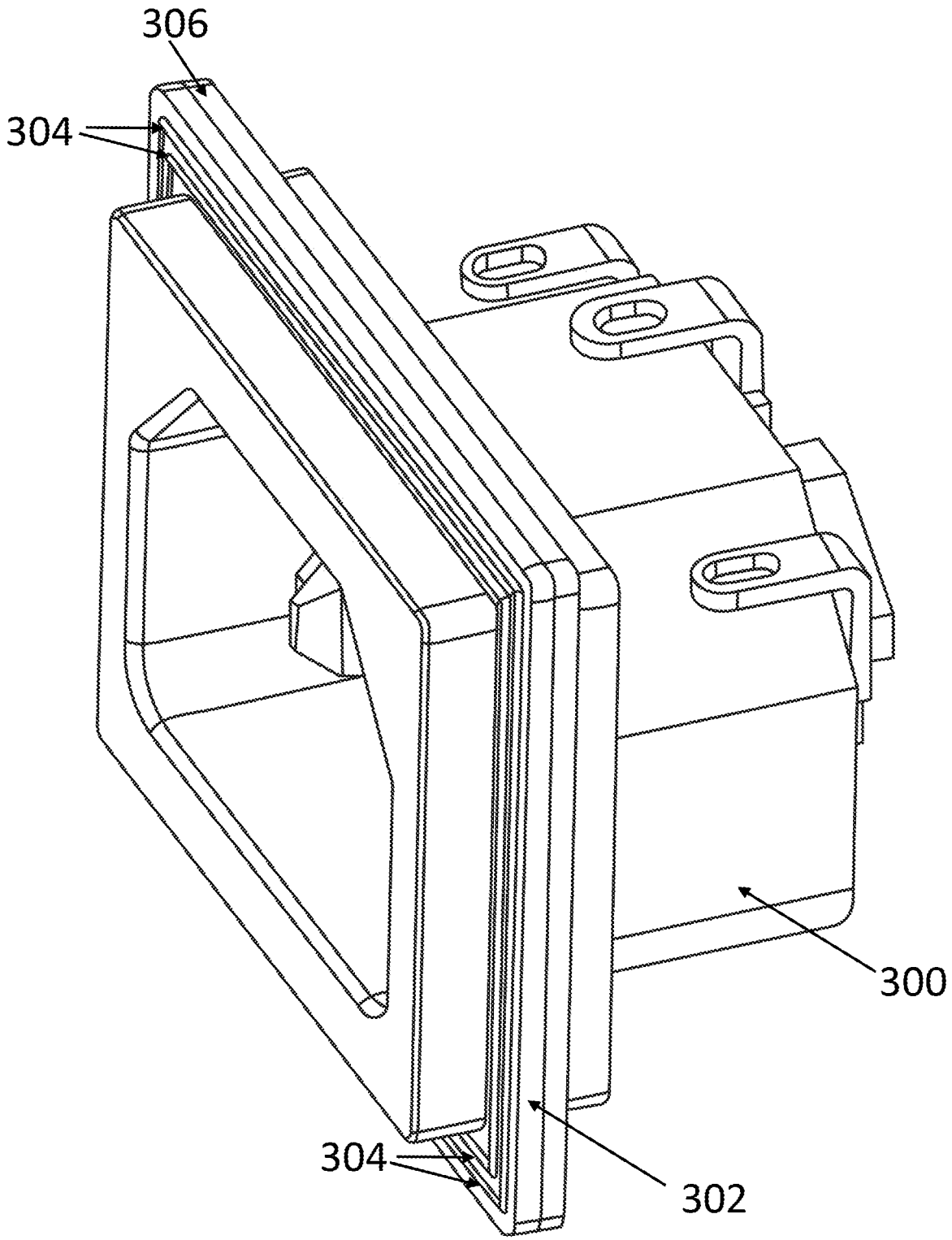
FIG. 4 illustrates a diagram showing an annular ring for preventing water from penetrating into the electronic product of the present invention mounted onto the electronic product in accordance with another embodiment.
Figure 5:
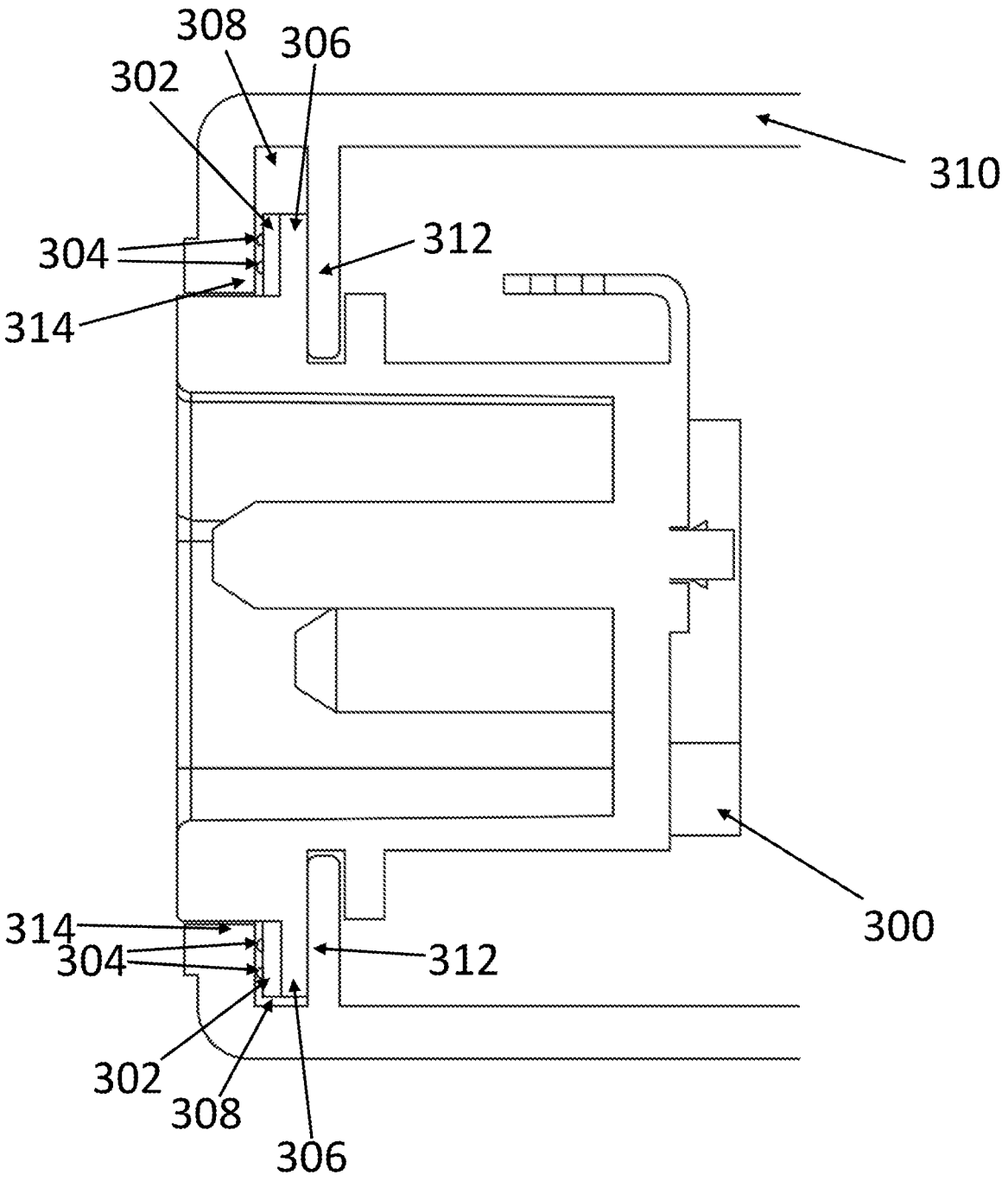
FIG. 5 illustrates a cross-sectional diagram showing the annular ring for preventing water from penetrating into the electronic product of the present invention mounted onto the electronic product in accordance with another embodiment.
Figure 6:
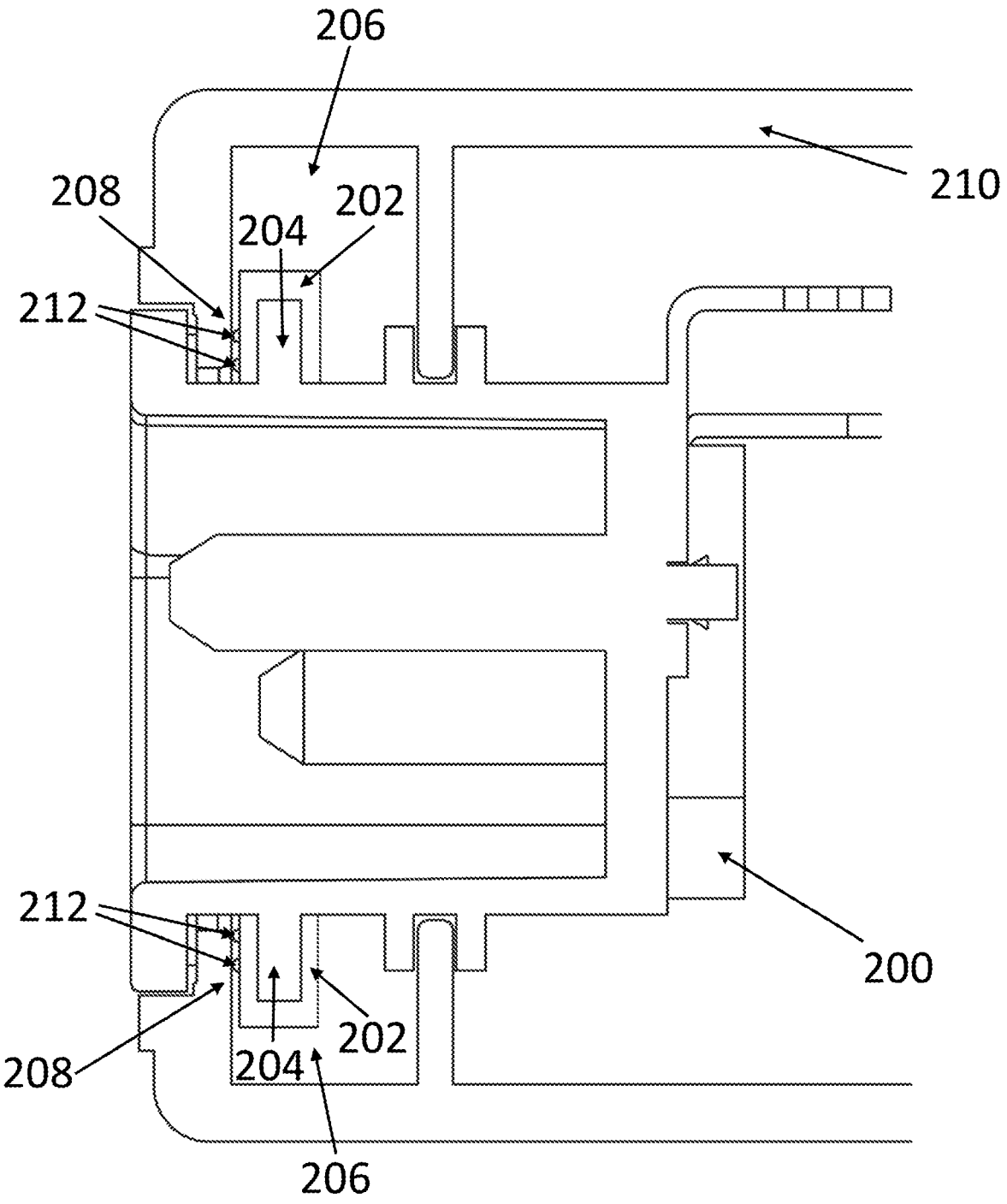
FIG. 6 illustrates a cross-sectional diagram showing the annular ring for preventing water from penetrating into the electronic product of the present invention mounted onto the electronic product in accordance with still another embodiment.
Figure 7:
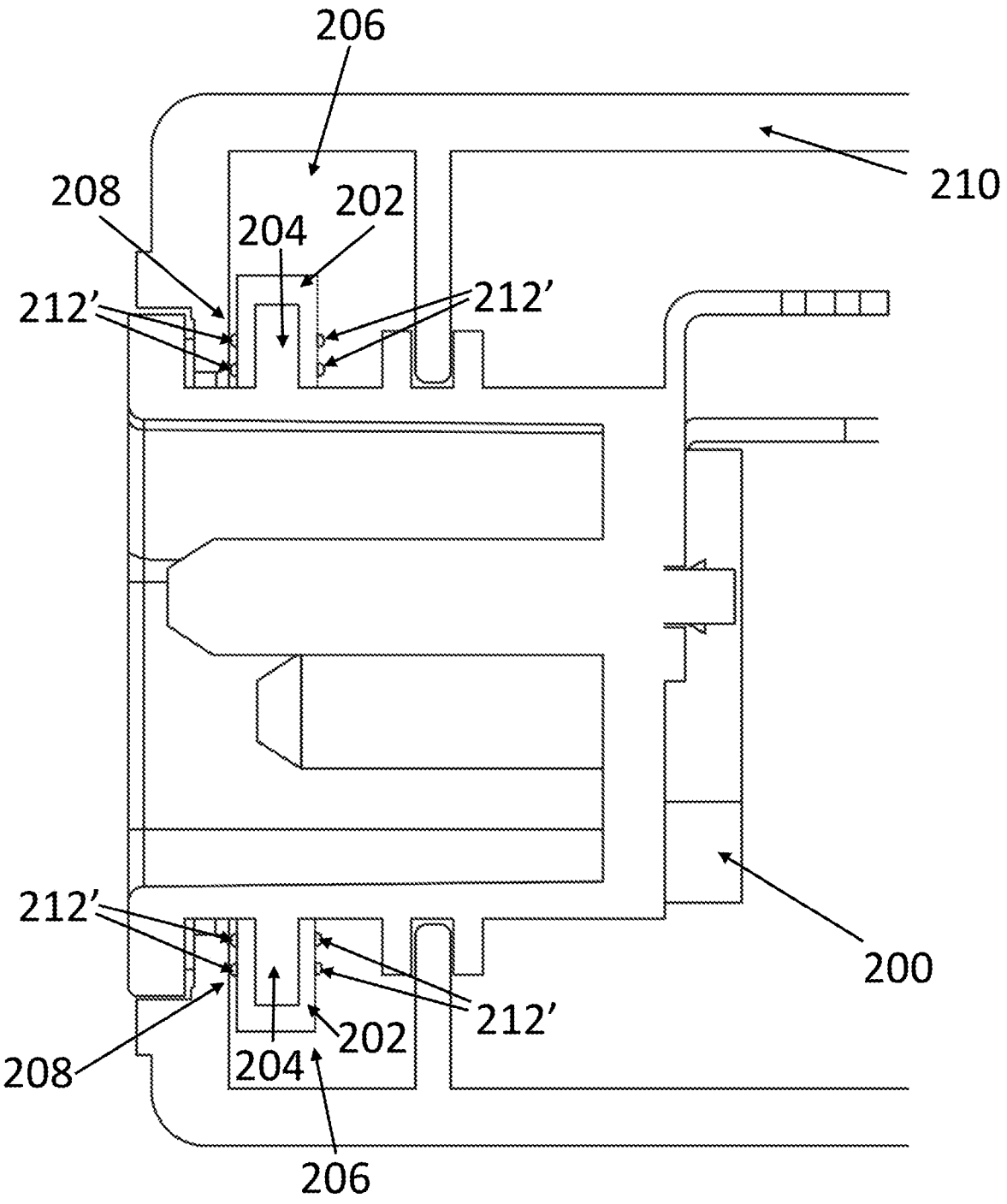
FIG. 7 illustrates a cross-sectional diagram showing the annular ring for preventing water from penetrating into the electronic product of the present invention mounted onto the electronic product in accordance with yet another embodiment.

Please further refer to FIGS. 4 and 5. In another embodiment of the present invention, the cross-section of the annular ring for preventing water from penetrating into the electronic product 302 of the present invention may be slice shaped. In one embodiment, the annular ring for preventing water from penetrating into the electronic product 302 may be manufactured by molding. In one embodiment, the annular ring for preventing water from penetrating into the electronic product 302 may be made of synthetic rubber (also known as thermosetting polymer) for example but not limited to butadiene rubber (BR), isobutylene isoprene rubber (IIR), complete supplement mixture (CSM), ethylene propylene diene monomer (EPDM), ethylene-propylene rubber (EPR), fluorocarbon (FKM), nitrile butadiene rubber (NBR), perfluoroelastomer (FFKM), polyacrylate rubber (ACR), chloroprene rubber (CR), polyisoprene rubber (IR), polysulfide rubber (PSR), silicone rubber (SIR), styrene butadiene rubber (SBR), or thermoplastics for instance but not limited to thermoplastic elastomer (TPE) (for example styrene), thermoplastic polyolefin (TPO) (such as low density polyethylene (LDPE), high density polyethylene (HDPE), linear low density polyethylene (LLDPE), ultra low density polyethylene (ULDPE)), thermoplastic polyurethane (TPU) (for instance polyether, polyester), thermoplastic polyester/polyether elastomers (TEEE), thermoplastic polyamide (TPA) (for example polyamide), melt processable rubber (MPR), thermoplastic vulcanizate (TPV). As shown in FIGS. 4 and 5, one or more strip-shaped protruded portions 304 may be formed on one or two lateral surfaces of the annular ring for preventing water from penetrating into the electronic product 302 to provide non-skid function. In one embodiment, as shown in FIGS. 4 and 5, the shape of the strip-shaped protruded portions 304 may be the same as that of the annular ring for preventing water from penetrating into the electronic product 302. For example, but not limited thereto, when the annular ring for preventing water from penetrating into the electronic product 302 is square shaped, the strip-shaped protruded portions 304 may be in the shape of square. With reference to FIGS. 4 and 5, the annular ring for preventing water from penetrating into the electronic product 302 may be disposed at a lateral side of a protruded edge 306 on the electronic product for instance but not limited to the socket 300 of the transformer, such that the lateral surface of the annular ring for preventing water from penetrating into the electronic product 302 tightly fits a lateral surface of the protruded edge 306. In one embodiment, the dimension and the shape of the annular ring for preventing water from penetrating into the electronic product 302 match the dimension and the shape of the protruded edge 306. As shown in FIG. 5, the annular ring for preventing water from penetrating into the electronic product 302 disposed at the lateral side of the protruded edge 306 may be further disposed in the concave groove 308 in the housing 310 together with the protruded edge 306, such that the annular ring for preventing water from penetrating into the electronic product 302 and the protruded edge 306 can tightly fit the lateral wall 314 and the lateral wall 312 of the concave groove 308 respectively, so as to achieve the waterproof effect. The lateral wall 314 is opposite to the lateral wall 312. In one embodiment, referring to FIG. 5, the width of the annular ring for preventing water from penetrating into the electronic product 302 plus the width of the protruded edge 306 may substantially equal the width of the concave groove 308, such that the annular ring for preventing water from penetrating into the electronic product 302 and the protruded edge 306 may be lodged in the concave groove 308. The annular ring can be mounted steadily, cannot be shifted easily, will not fall off easily and will not have waterproof effect reduced due to different assembling methods because the annular ring for preventing water from penetrating into the electronic product 302 shown in FIGS. 4 and 5 has one or more strip-shaped protruded portions 304 which can enhance frictional force between the lateral wall 314 of the concave groove 308 and the annular ring for preventing water from penetrating into the electronic product 302 to provide non-skid function. It should be appreciated by the person having ordinary skill in the art that FIGS. 4 and 5 are shown for illustrating, not for limiting the present invention. Therefore, the annular ring for preventing water from penetrating into the electronic product 302 is not limited to the square shape shown in FIGS. 4 and 5, and may be in the shape of circle, rectangle, hexagon or any other applicable shapes.

As aforementioned, the annular ring for preventing water from penetrating into the electronic product of the present invention can achieve the function of enabling the annular ring to be mounted steadily and easily, and rendering the annular ring not to be shifted easily, not to fall off easily and not to have waterproof effect reduced due to different assembling methods because of special U-shaped notch or one or more strip-shaped protruded portions.

The foregoing description is a preferred embodiment of the present invention. It should be appreciated that this embodiment is described for purposes of illustration only, not for limiting, and that numerous alterations and modifications may be practiced by those skilled in the art without departing from the spirit and scope of the present invention. It is intended that all such modifications and alterations are included insofar as they come within the scope of the present invention as claimed or the equivalents thereof.

What is claimed is:

1. An annular ring device for preventing water from penetrating into a transformer, wherein said transformer includes a housing and a socket disposed in said housing, wherein said housing includes a concave groove formed therein, wherein said socket includes a protruded edge formed on a side surface thereof, said annular ring comprising:

an annular ring body, a cross-section of said annular ring body having a shape with a concave notch;

wherein said protruded edge is disposed within said notch, wherein one or more strip-shaped protruded portions are formed on one or two outer lateral surfaces of said annular ring body to provide anti-skid function.

2. The annular ring device of claim 1, wherein an outer lateral surface of said annular ring body fits a lateral wall of said concave groove.

3. An annular ring device of claim 1, wherein said shape with said concave notch includes U shape.

4. An annular ring device of claim 1, wherein said annular ring body is square or circular.

5. An annular ring device for preventing water from penetrating into a transformer, wherein said transformer includes a housing and a socket disposed in said housing, wherein said housing includes a concave groove formed therein, wherein said socket includes a protruded edge formed on a side surface thereof, said annular ring comprising:

an annular ring body, wherein a cross-section of said annular ring body is slice shaped;

wherein said annular ring body is disposed at a lateral side of said protruded edge, such that a lateral surface of said annular ring body fits a lateral surface of said protruded edge, wherein one or more strip-shaped protruded portions are formed on another lateral surface of said annular ring body to provide anti-skid function, a material of said annular ring body includes butadiene rubber (BR), isobutylene isoprene rubber (IIR), complete supplement mixture (CSM), ethylene propylene diene monomer (EPDM), ethylene-propylene rubber (EPR), fluorocarbon (FKM), nitrile butadiene rubber (NBR), perfluoroelastomer (FFKM), polyacrylate rubber (ACR), chloroprene rubber (CR), polyisoprene rubber (IR), polysulfide rubber (PSR), silicone rubber (SIR), styrene butadiene rubber (SBR), styrene, low density polyethylene (LDPE), high density polyethylene (HDPE), linear low density polyethylene (LLDPE), ultra low density polyethylene (ULDPE), polyether, polyester, thermoplastic polyester/polyether elastomers (TEEE), polyamid, melt processable rubber (MPR) or thermoplastic vulcanizate (TPV).

6. The annular ring device of claim 5, wherein said another lateral surface fits a lateral wall of said concave groove.

7. The annular ring device of claim 5, wherein said annular ring body is square or annular.

8. A waterproof structure device for preventing water from penetrating into a transformer, said transformer includes a transformer housing, said transformer housing having a protruded edge and a concave groove formed therein, said waterproof structure comprising:

an annular ring body, a cross-section of said annular ring body having a shape with a concave notch, wherein said protruded edge is disposed within said notch, wherein an outer lateral surface of said annular ring body fits a lateral wall of said concave groove, wherein one or more strip-shaped protruded portions are formed on one or two outer lateral surfaces of said annular ring body to provide anti-skid function.

9. The waterproof structure device of claim 8, wherein said shape with said concave notch includes U shape.

10. The waterproof structure device of claim 8, wherein said annular ring body is square or circular.

* * * * *